US006062676A

United States Patent [19]

Larson

[11] Patent Number: 6,062,676

[45] Date of Patent: May 16, 2000

[54] SERIAL PRINTING SYSTEM WITH DIRECT DEPOSITION OF POWDER PARTICLES

[75] Inventor: Ove Larson, Hagen-Langedrag, Sweden

[73] Assignee: Array Printers AB, Sweden

[21] Appl. No.: 08/929,179

[22] Filed: Sep. 8, 1997

Related U.S. Application Data

[63] Continuation of application No. 08/356,699, Dec. 15, 1994, abandoned.

[51] Int. Cl.[7] ..... B41J 2/06; B41J 2/165

[52] U.S. Cl. ..... 347/55; 347/22

[58] Field of Search ..... 347/55, 141, 158, 347/156, 112, 33, 22

[56] References Cited

U.S. PATENT DOCUMENTS 3,566,786 3/1971 Kaufer et al. .
3,689,935 9/1972 Pressman et al. .
3,779,166 12/1973 Pressman et al. .
3,815,145 6/1974 Tisch et al. .
4,263,601 4/1981 Nishimura et al. .
4,274,100 6/1981 Pond .
4,340,693 7/1982 Ort ..... 347/102
4,353,080 10/1982 Cross .
4,382,263 5/1983 Fischbeck et al. .
4,384,296 5/1983 Torpey .
4,386,358 5/1983 Fischbeck .
4,470,056 9/1984 Galetto et al. .
4,478,510 10/1984 Fujii et al. .
4,491,794 1/1985 Daley et al. .
4,491,855 1/1985 Fujii et al. .
4,498,090 2/1985 Honda et al. .
4,511,907 4/1985 Fukuchi ..... 347/43 X
4,525,727 6/1985 Kohashi et al. .
4,571,601 2/1986 Teshima ..... 347/33
4,675,703 6/1987 Fotland .
4,717,926 1/1988 Hotomi ..... 347/55
4,743,926 5/1988 Schmidlin et al. .
4,748,453 5/1988 Lin et al. ..... 347/41
4,814,796 3/1989 Schmidlin .
4,831,394 5/1989 Ochiai et al. .
4,860,036 8/1989 Schmidlin .
4,903,050 2/1990 Schmidlin .
4,912,489 3/1990 Schmidlin .
5,028,812 7/1991 Bartky .
5,036,341 7/1991 Larsson .
5,038,159 8/1991 Schmidlin et al. .
5,057,855 10/1991 Damouth .
5,072,235 12/1991 Slowik et al. .
5,083,137 1/1992 Badyal et al. .
5,095,322 3/1992 Fletcher .
5,121,144 6/1992 Larson et al. .
5,128,695 7/1992 Maeda ..... 347/55
5,148,595 9/1992 Doggett et al. .
5,170,185 12/1992 Takemura et al. .
5,181,050 1/1993 Bibl et al. .
5,204,696 4/1993 Schmidlin et al. .
5,204,697 4/1993 Schmidlin .
5,214,451 5/1993 Schmidlin et al. .
5,229,794 7/1993 Honman et al. .
5,235,354 8/1993 Larson .
5,237,346 8/1993 Da Costa et al. .
5,256,246 10/1993 Kitamura .
5,257,045 10/1993 Bergen et al. .
5,270,729 12/1993 Stearns .
5,274,401 12/1993 Doggett et al. .
5,307,092 4/1994 Larson .
5,329,307 7/1994 Takemura et al. .
5,374,949 12/1994 Wada et al. .
5,386,225 1/1995 Shibata .
5,402,158 3/1995 Larson .
5,414,500 5/1995 Furukawa .
5,446,478 8/1995 Larson .
5,450,115 9/1995 Bergen et al. .
5,453,768 9/1995 Schmidlin .
5,473,352 12/1995 Ishida .
5,477,246 12/1995 Hirabayashi et al. ..... 347/43 X
5,477,250 12/1995 Larson .
5,506,666 4/1996 Masuda et al. ..... 347/156 X
5,508,723 4/1996 Maeda .
5,515,084 5/1996 Larson .
5,526,029 6/1996 Larson et al. .
5,558,969 9/1996 Uyttendaele et al. .
5,559,586 9/1996 Wada .
5,600,355 2/1997 Wada .
5,614,932 3/1997 Kagayama .
5,617,129 4/1997 Chizuk, Jr. et al. .
5,625,392 4/1997 Maeda .
5,640,185 6/1997 Kagayama .
5,650,809 7/1997 Kitamura .
5,666,147 9/1997 Larson .

| | | |
|---|---|---|
| 5,677,717 | 10/1997 | Ohashi . |
| 5,708,464 | 1/1998 | Desie . |
| 5,774,159 | 6/1998 | Larson . |
| 5,805,185 | 9/1998 | Kondo . |
| 5,818,480 | 10/1998 | Bern et al. . |
| 5,818,490 | 10/1998 | Larson . |
| 5,847,733 | 12/1998 | Bern . |

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4-282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

OTHER PUBLICATIONS

E. Bassous, et al., "The Fabrication of High Precision Nozzles by the Anisotropic Etching of (100) Silicon", *J. Electrochem. Soc.: Solid–State Science and Technology,* vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies,* 1994, pp. 311–313.

"The Best of Both Worlds," Brochure of Toner Jet® by Array Printers, *The Best of Both Worlds,* 1990.

*Primary Examiner*—David F. Yockey
*Attorney, Agent, or Firm*—Knobbe, Martens, Olson & Bear, LLP

[57] ABSTRACT

A movable printhead having a screen or lattice-shaped control electrode matrix prints each page as a series of narrow bands across the width of the page. An information carrier such as paper is placed between a back electrode and the control electrode matrix, both of which are connected to voltage sources. Voltage sources connected to the control electrode matrix at least partially open and close passages through the control electrode matrix. Charged pigment particles attracted from a particle carrier through open passages are deposited on the information carrier to form visible images. In one embodiment, a particle carrier is rotated in opposite directions in response to the direction of movement of the printhead. In another embodiment, a cleaning assembly having a magnetic roll and located outside the printing area removes unwanted pigment particles from the control electrode matrix. In another embodiment, two stationary belts, a tooth wheel, a mechanical angle link, a rotary belt, and two single-direction wheels are arranged to rotate a particle carrier in a same direction regardless of the direction the printhead is moved.

6 Claims, 8 Drawing Sheets

SERIAL PRINTING SYSTEM WITH DIRECT DEPOSITION OF POWDER PARTICLES

This application is a continuation of U.S. patent application Ser. No. 08/356,699, filed Dec. 15, 1994, now abandoned.

The invention relates to a system to reduce the physical size and manufacturing cost of printing mechanisms that use a matrix of individual control electrodes to produce electrostatic field patterns for transporting pigment particles from a particle carrier to an information carrier and devices to perform the method.

BACKGROUND OF THE INVENTION

There is a continuing need for low-cost printing mechanisms for use with personal computers, facsimile machines, and the like, especially printing mechanisms that use so-called plain paper such as used in office photocopiers. There is also a need for small-size printing mechanisms that can be compatible with portable personal computers, especially those small enough to be incorporated in the computer case.

Serial impact printers have long filled the need for low-cost printing by using an array of needle-like print elements that are driven against an inked ribbon and paper to transfer ink from the ribbon to the paper surface. Serial printers move that array of print elements, called a printhead, across the page to print a band of text or graphic images. At the ending edge of the page the printhead is returned to the starting edge of the page while the page is moved forward the distance of one band. A next band of printing is then placed on the page adjacent to the previous band. Printed bands are successively printed until the page is filled or the printing task is complete. While being low cost, impact printers are limited in resolution and speed and produce more sound than is acceptable in many office environments.

Nonimpact printers, such as serial liquid ink jet printers, offer higher resolution and lower sound levels by using an array of individual droplet generators that eject liquid ink droplets toward a paper surface where they are deposited in the desired image pattern. The printhead and page motion are similar to that previously described for impact serial printers. A limitation of ink jet printers is that spreading of the liquid ink in the plain paper fibers can produce unacceptable images. A special coated paper is often required to produce acceptable image quality. Ink jet printers are also limited in printing speed by the droplet production rate unless large numbers of jets are used, which significantly increases the printer cost.

Nonimpact printers such as serial phase change ink jet printers use an array of individual droplet generators to eject droplets of molten wax-like material that solidify on impact with the papers surface before significant spreading can occur. This enables using plain paper, but often produces an objectional raised image similar to an embossed image.

Nonimpact line printers such as laser printers are able to meet the speed and plain paper requirements by printing the full width of the page at one time, rather than a portion of a band at a time as do the serial printers described earlier. Printing a full line at once increases the machine cost and size, preventing laser printers from meeting the low-cost or small-size requirements.

One printing technology that can meet the requirements of small size, plain paper, low sound, and low cost is disclosed in U.S. Pat. No. 5,036,341 wherein pigment particles are deposited directly on plain paper in the image pattern. The method of that patent brings an information carrier such as paper between a back electrode and a screen or lattice-shaped control electrode matrix of individual wires, all of which are connected to voltage sources. Voltage sources connected to the individual wires of the control electrode matrix at least partially open and close passages through the electrode matrix. Pigment particles are attracted from a particle carrier through the open passages and are deposited on the information carrier to form visible images. The paper is moved with respect to the electrode matrix to produce a line at a time.

The two-dimensional control electrode matrix of the above-mentioned patent is a lattice of individual wires arranged in rows and columns with one electronic drive circuit for each row or column wire. Operation of the control electrode matrix composed of individual wires can be sensitive to opening or closing of adjacent passages, resulting in undesired printing: a defect called cross-coupling.

U.S. Pat. No. 5,121,144 shows a control electrode matrix on a single insulating layer with one circular electrode surrounding each passage to eliminate the cross-coupling. The electrodes are arranged in rows and columns on a single insulating substrate with a single electronic drive circuit needed for each electrode. The use of one electronic driver per electrode on a single insulating layer is effective in eliminating cross-coupling, but increases the manufacturing costs by an undesirable amount because of the large number of electronic drive circuits required.

SUMMARY OF THE INVENTION

By using a small number of electrodes arranged in a moving printhead, such as the serial printer mechanism described previously, the number of electronic drivers can be drastically reduced from that required for line or full page width printing. This then enables a low-cost printer of small size and low sound level and using plain paper to produce printing of good quality. A device for fusing pigment particles may be attached to the moving printhead.

The object of the invention is to create a method and apparatus that gives low-cost printing on plain paper with a size and sound level compatible with use in portable personal computer applications.

The printer includes a printhead supported on parallel rods or a double helix drive screw. Also disclosed are mechanisms for rotating the printhead particle carrier in opposite directions as the printhead is moved, or a mechanism for rotating the carrier in single direction as the printhead moves in opposite directions. Included also is a system for cleaning the electrode matrix.

DESCRIPTION OF EMBODIMENTS

Figure 1A:
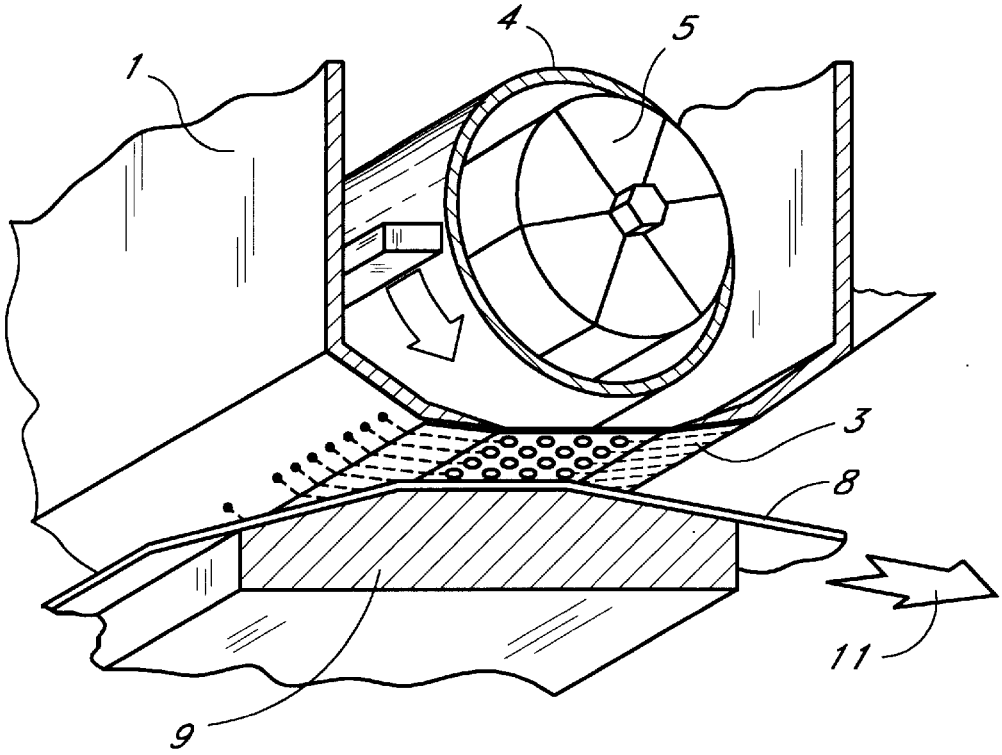
Fig. 1a (Prior Art)
FIG. 1*a* is a schematic perspective view of a section through one embodiment of the prior art technology.
Figure 1B:
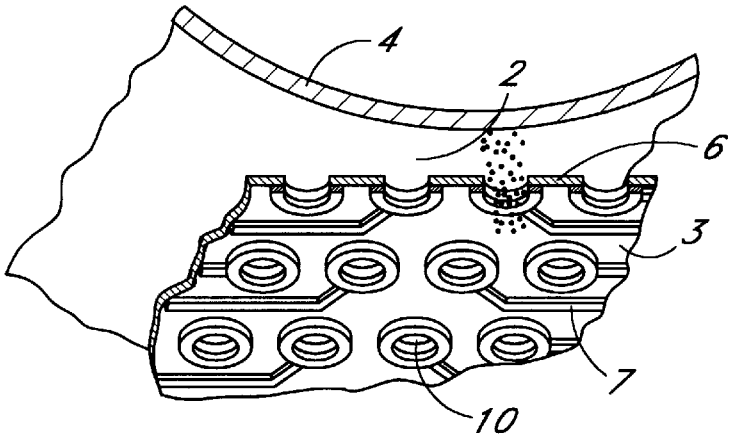
Fig. 1b (Prior Art)
FIG. 1*b* is an enlargement of the control electrode matrix of FIG. 1*a*.

FIGS. 1*a* and 1*b* show a printer using the prior art disclosed in U.S. Pat. No. 5,036,341 and U.S. Pat. No. 5,121,144, which are incorporated herein. A container 1 for pigment particles 2, e.g., toner, also acts as a mounting surface for a control electrode matrix 3. A particle carrier, e.g., a developing roller 4 within container 1, encloses a multiple magnetic core 5 for attraction of pigment particles 2 toward the developing roller 4. A substrate 6 supports control electrodes 7 of control electrode matrix 3. An information carrier 8, called paper, is located on a back electrode 9. A voltage source (not shown) connected to back electrode 9 attracts charged pigment particles 2 from the developing roller 4 through a plurality of apertures 10 in the control electrode 7, depositing the particles on the information carrier 8. Control voltage signals from a source (not shown) are connected to the control electrode matrix 3 to create electric fields that partially open or close the apertures 10 to passage of toner particles, producing a visible image pattern on the information carrier 8 corresponding to the pattern of the control voltage signals. The information carrier 8 is moved across the back electrode 9 under the control electrode matrix 3 in the direction of an arrow 11 while the container 1 is stationary. A means of fusing the pigment particles to the paper (not shown) is located after the container 1 along the paper motion direction 11. The method of fusing uses an energy source such as heat or mechanical pressure or heated mechanical pressure or chemical solvent to soften the pigment particles, causing them to flow into the fibers of the paper 8.

Figure 2B:
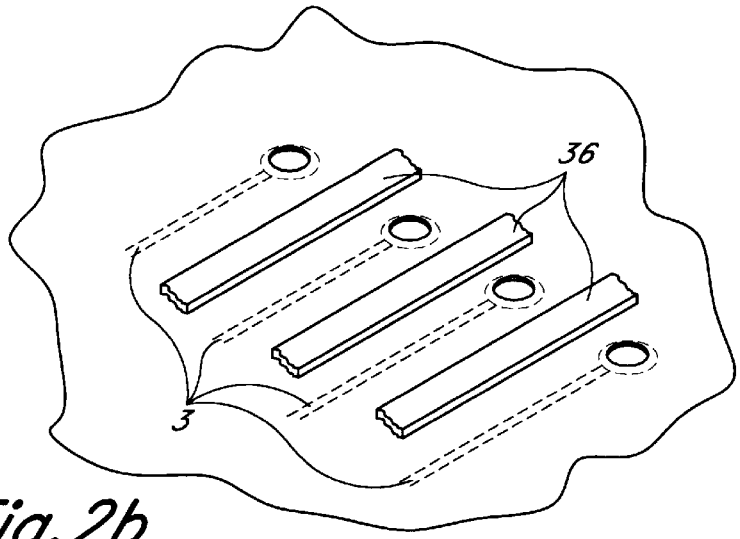
FIG. 2*a* and enlarged view FIG. 2*b* are schematic perspective views of one embodiment of the present invention as a serial printer.
Figure 2A:
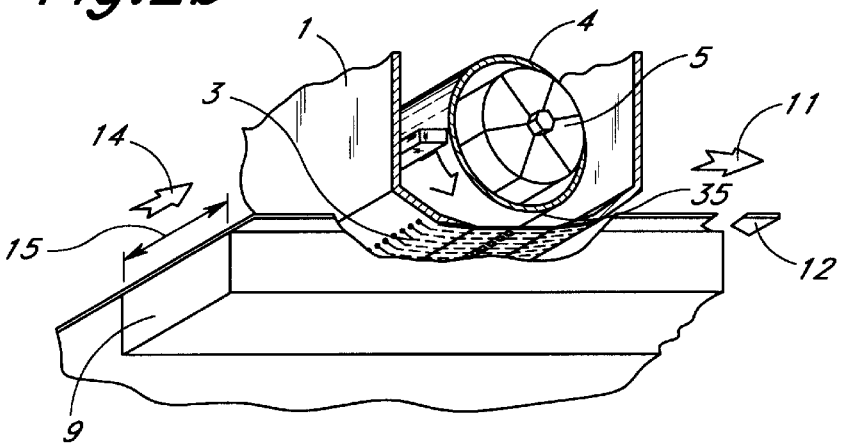

In accordance with the present invention, as shown in FIGS. 2*a* and 2*b*, the dontainer supporting the particle carrier 4 and the control electrode matrix 3 is moved with respect to the plain paper 8 while remaining a constant distance from the fixed back electrode 9. Toner particles are deposited in an image pattern on the paper until reaching an edge 12 of the paper, where the container 1 is stopped and returned to the near edge of the page 13. The paper is advanced in the direction 14 by a distance equal to the print width or height 15 of the control electrode matrix 3, and the container 1 is moved in the direction 11 to print the next line or band. While the print width (height) 15 perpendicular to the direction 11, may be of various dimensions, it is contemplated to be small relative to the corresponding dimension of the arrangement of FIG. 1, which would normally extend across the width of the desired print on the paper 8. Also, it is contemplated that there only be a single row of electrodes in the print head moving across the paper. Thus, the number of electrodes 3 and control circuits is very small relative to that of the fixed matrix 3 of FIG. 1. Printing can proceed one line at a time, but to shorten the print time a band providing five or six lines, depending on type size, has been found to be practical.

For example, a single-row linear array of 128 control electrodes, spaced at 100 per inch to form the printhead depth 15, are aligned perpendicular to the printhead motion direction 11. After printing a band of 128 dot rows across the width of the paper, the paper is advanced 129 rows for printing the next band of dot rows. This method produces an image of 100 dots per inch on the paper.

Higher fidelity printing is achieved by interlacing the dot rows. For example, after printing the first band of 128 dot rows, the paper is advanced one half dot row; and a second interlaced band of dot rows is printed to produce an image band of 200 dots per inch. The next paper advance is 128 and one half dot rows, and then one half row, alternating for the full length of the page. Similarly, an image of 400 dots per inch is produced by advancing the paper one quarter dot row after printing the first band of 128 rows. Then a second interlaced band of dot rows is printed. Third and fourth bands of dot rows are also printed at one quarter dot row intervals, producing an image band of 400 dots per inch. Paper advance sequence is thus ¼, ¼, ¼, 128 and ¼ dot rows in succession.

The distance 35 between the particle carrier 4 and the control electrode matrix 3 has been found to be very critical to printing performance. The distance 35 should be as small as possible, preferably less than 100 $\mu$m. The single row linear array of control electrodes spaced at 100 per inch permits a series of spacers 36 to be located between the electrodes for control of the distance 35.

The pigment particle image may be fixed to the paper by a device located after the back electrode in the direction of paper motion 14 using any of the methods employed in the prior art previously described.

Figure 3:
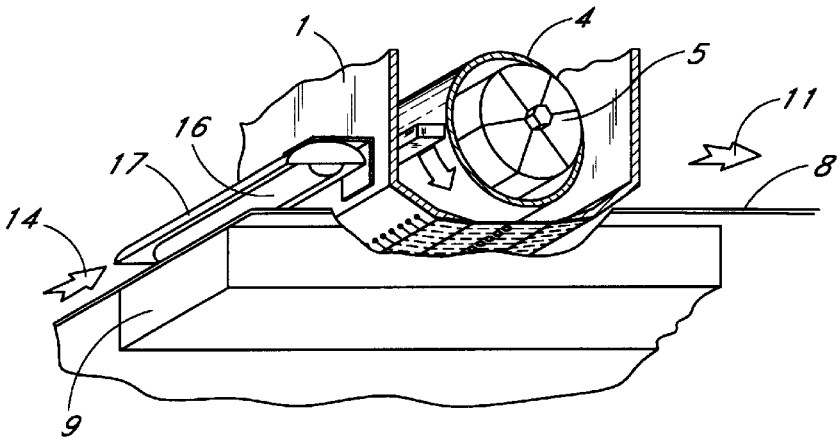
FIG. 3 is a schematic perspective view of another embodiment of the present invention as a serial printer with a fusing device attached to the printhead.

An alternative preferred embodiment of fixing is shown in FIG. 3 where a source of radiant energy 16 in a reflector housing 17 is attached to container 1 on the side following printing. That radiant energy softens the pigment particles 2, causing them to flow into the fibers of the paper 8 where they solidify to form a permanent image. This preferred embodiment is more suited to the small physical size requirements of portable personal computers.

Fusing of the pigment particles in the paper surface requires that the particle temperature be raised above about 140° C. The radiant energy to produce that temperature rise while the heat source 16 is moving at about 200 mm/sec is about two watts at the paper surface. An experimental printer uses a focused infrared spot heater, such as the model 4141 of Research, Inc., of Eden Prairie, Minn.

Figure 4:
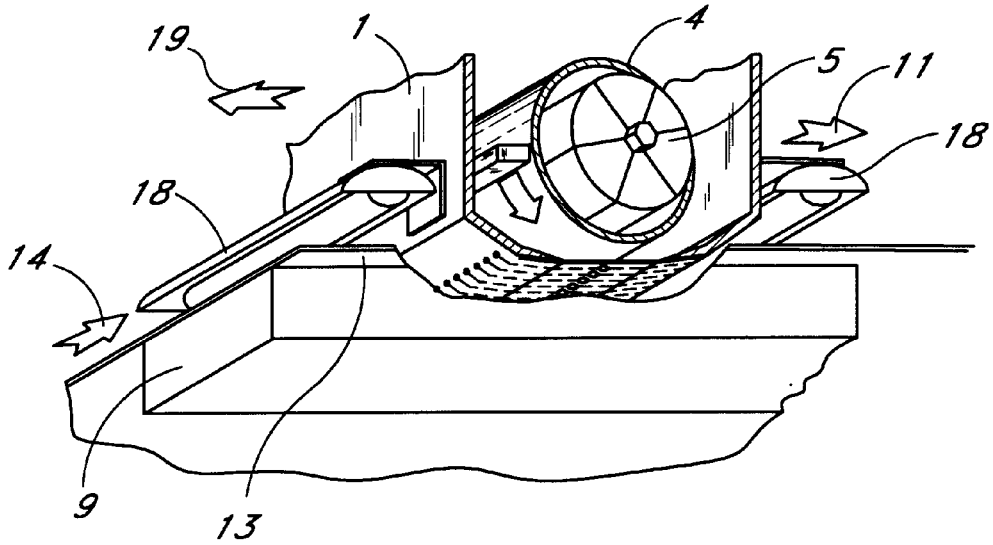
FIG. 4 is a schematic perspective view of another embodiment of the present invention as a serial printer with two fusing devices attached to the printhead for printing in either direction of printhead motion.

FIG. 4 shows another embodiment of the invention having two fusing assemblies 18 attached to the container 1 and a reversible motion control (not shown) that allows printing in either direction of motion 11, 19 of container 1. This embodiment provides higher printing speed by eliminating the delay associated with returning the printhead to the near edge of the page after completion of printing each individual band of images. The container 1 moves in the direction 11, printing a band of images until it reaches the end edge of paper 12. The printing stops while the container motion is reversed, and the paper is advanced the width of one band. The container then moves and prints in the direction 19 until it reaches the near edge of paper 13. This process continues, printing each band of images in an alternate direction. Image bands can be adjacent bands of complete images or interlaced bands of partial images.

Figure 5:
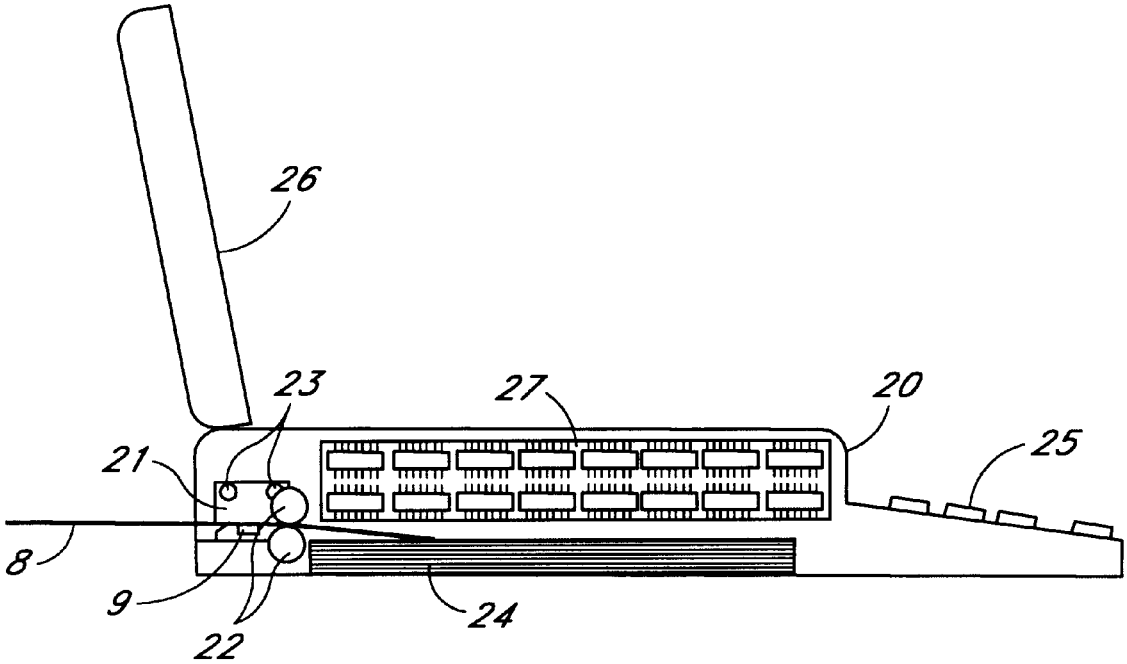
FIG. 5 is a schematic section view of an embodiment of the invention as a serial printer inside a portable personal computer case.

FIG. 5 shows an implementation of this invention as a serial printer mechanism included in a personal computer case 20. A sheet of paper 8 is moved from a tray 24 between a printhead 21 and a back electrode 9 by drive rollers 22. The printhead 21 supported by guide rods 23, parallel to the back electrode 9, is driven by a motor (not shown) while printing a band of images. Other portions of the personal computer shown are the keyboard 25, display 26, and circuit card 27.

Figure 6:
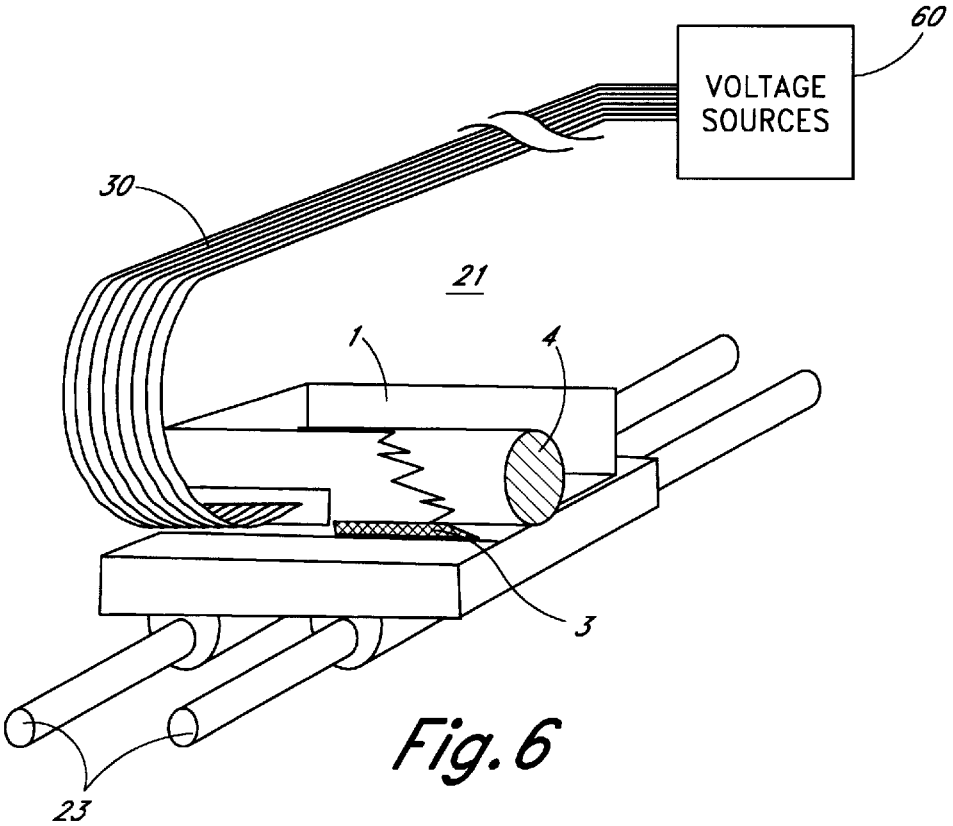
FIG. 6 is a schematic, enlarged perspective view of one embodiment of a moving printhead.

Electrical signals from voltage sources 60 and power may be connected to the moving printhead by a flat ribbon cable 30, as shown in the sketch of FIG. 6. The cable is constrained to move in a single axis, as is well known in the serial printer technology.

Figure 7A:
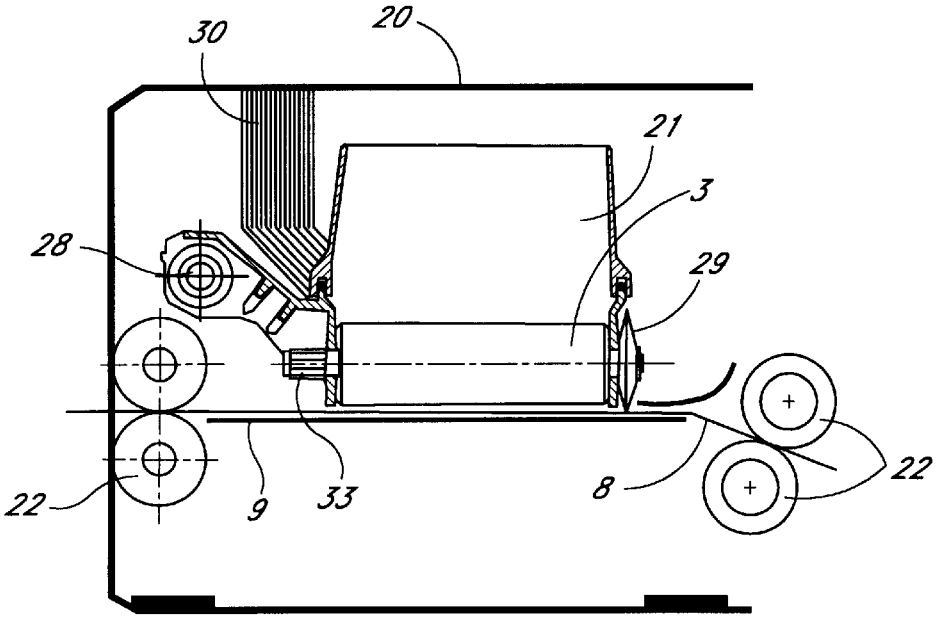
FIG. 7*a* is a schematic, side elevational view of an alternate method of supporting a printhead.
Figure 7B:
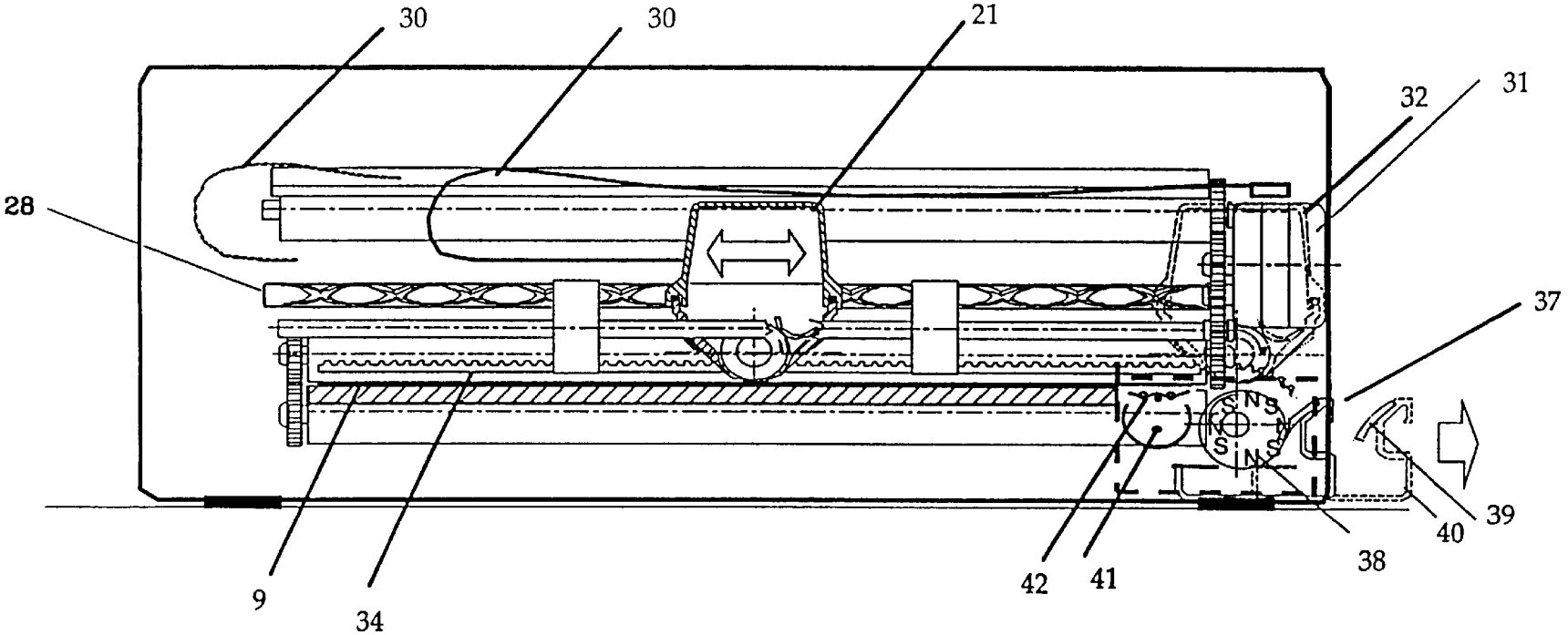
FIG. 7*b* is a schematic, rear elevational view of the apparatus of FIG. 7*a*, including a matrix cleaning assembly.

An alternate method of supporting the printhead 21 is shown in FIGS. 7*a* and 7*b*. A double helix drive screw 28 supports one side of the printhead 21, while a printhead guide wheel 29, engaging the paper 8, supports the other side of the printhead and maintains a constant distance between the printhead 21 and the back electrode 9. The double helix drive screw 28 also converts the torque from a motor 31 to a force that moves the printhead 21 across the paper 8. When the printhead 21 reaches either end of travel, the double helix drive screw 28 reverses the direction of printhead motion without reversing the motor direction.

A rest position 32 is provided past the paper edge where the printhead 21 is located during inactive periods and during paper motion between print bands. The printhead guide wheel 29 then does not interfere with paper motion. A pinon gear 33 on the printhead engages a rack 34 to turn the particle carrier 4 in a direction dependent on the direction of motion of printhead 21 as it moves across paper 8.

Figure 9:
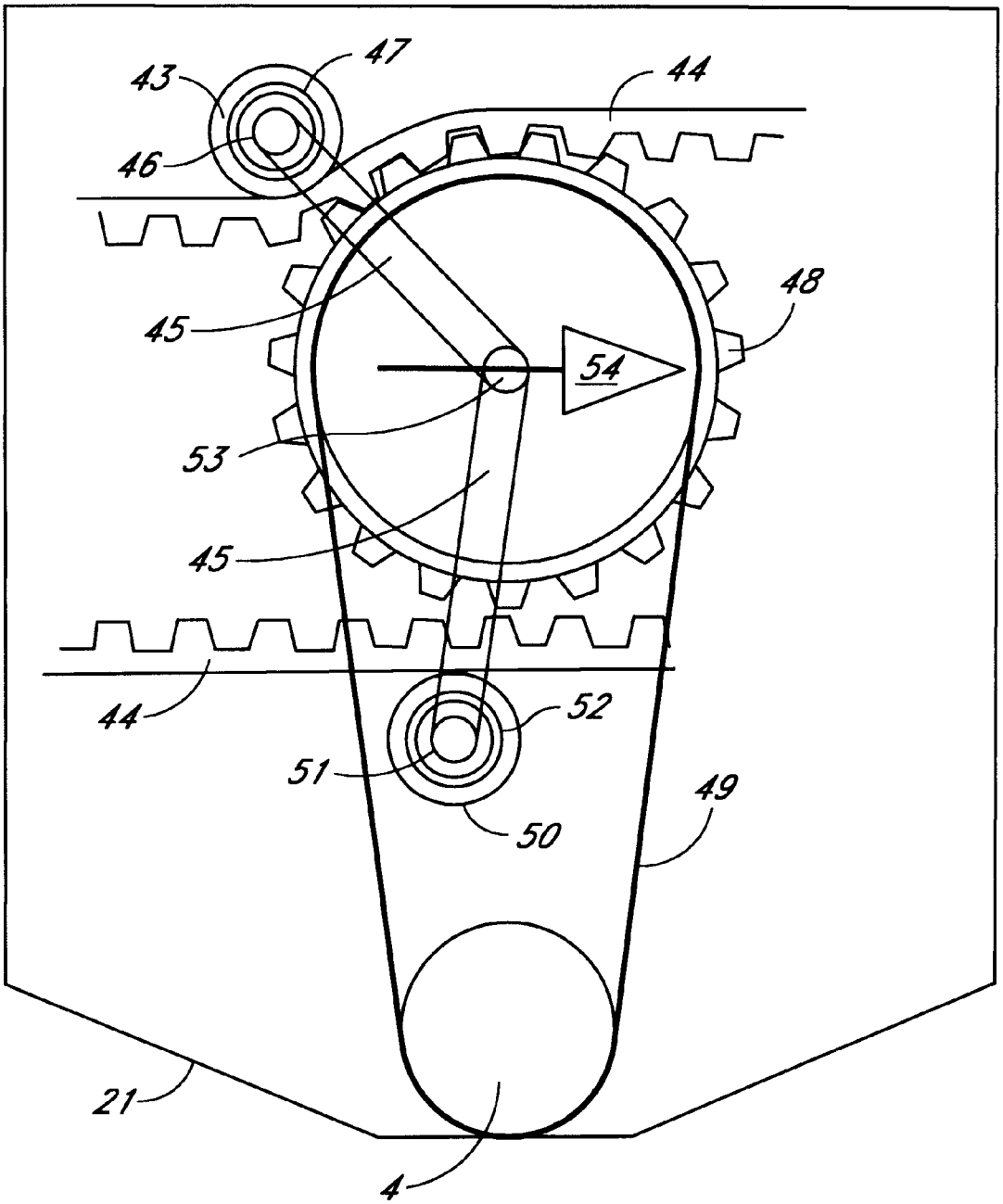
FIG. 9 is a schematic view of an alternate arrangement for rotating a particle carrier.

As an alternate method, the particle carrier 4 may be rotated in only one direction, regardless of the direction of motion of the printhead 21. As shown in FIG. 9, when the printhead 21 is moved in the direction of an arrows 54, an upper wheel 43 is moved into contact with a stationary toothbelt 44 by a force from an angle link 45. The upper wheel 43 is supported on a shaft 46 by a one-way clutch 47, which allows rotation of wheel 43 in only the counterclockwise direction, as viewed in FIG. 9. The contact force of the wheel 43 on the toothbelt 44 causes the toothbelt to engage a toothwheel 48, which in turn causes a belt 49 and the particle carrier 4 to rotate in the counterclockwise direction. When the printhead 21 reverses direction, the resistance to rotation by the one-way clutch 47 causes the angle link 45 to rotate on a shaft 53, bringing a lower wheel 50 into contact with the lower segment of the toothbelt 44. The lower wheel 50 is supported on shaft 51 by a one-way clutch 52, which allows rotation of wheel 50 in only the counterclockwise direction. The contact force of the wheel 50 on the toothbelt 44 causes the toothbelt to engage the toothwheel 48, which in turn causes the belt 49 and the particle carrier 4 to rotate in the counterclockwise direction.

Figure 8:
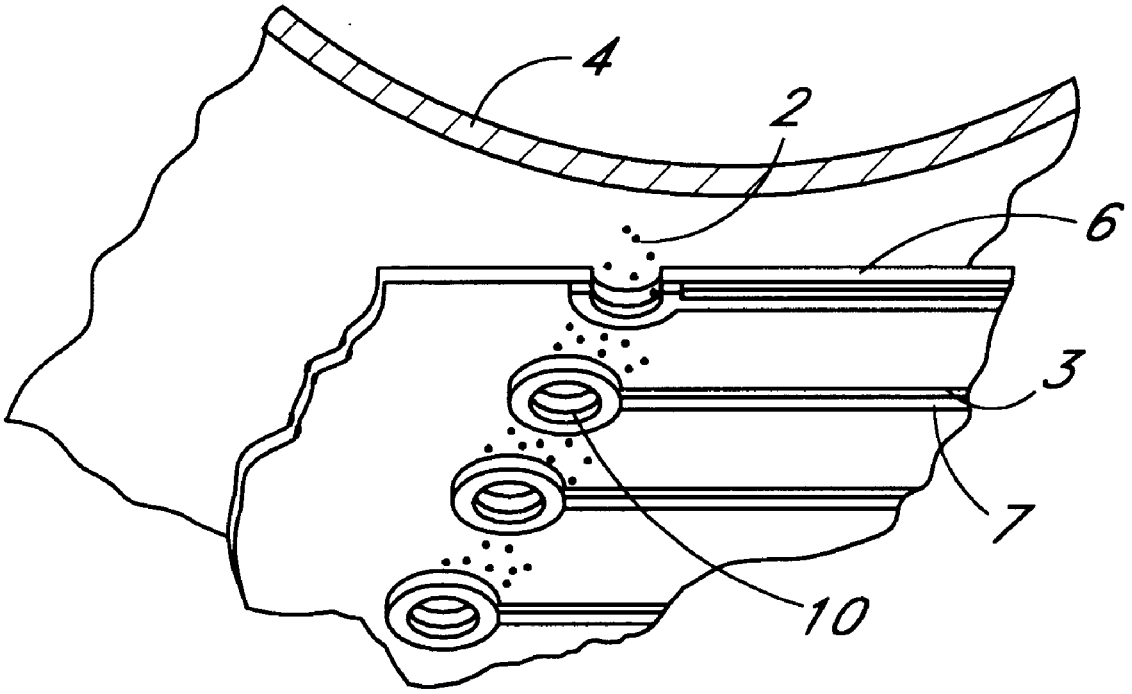
FIG. 8 is an enlarged fragmentary view of an electrode matrix, schematically illustrating toner particle attached to an insulating substrate.

Experience has shown that random toner particles 2 may become attached to the insulating substrate 6 of the control electrode matrix 3, as shown in FIG. 8. If allowed to accumulate, those particles will interfere with proper operation of the printer. An area 32 is provided past the paper edge where toner particles are removed from the control electrode matrix by a cleaning assembly 37, schematically illustrated by the broken line box of FIG. 7*b*. The cleaning assembly 37 includes a rotatable multiple pole magnet roll 38, a cleaning blade 39, a waste container 40, a corona wire 41, and a wire mesh grid electrode 42. A cleaning cycle comprises moving the printhead 21 over the rotating magnet roll 38, causing magnetic toner particles 2 attracted to the magnet roll 38 to be removed by the cleaning blade 39 and deposited in waste container 40. At the start of printing, the printhead 21 moves over a corona wire 41 and a wire grid 42, which generate ions to discharge and establish a uniform initial potential on the control electrode matrix 3. A coating of conducting or partially conducting material applied to the surface of the control electrode matrix 3 has also been found to be effective in establishing a uniform potential on the surface of the control electrode matrix 3.

Figure 10:
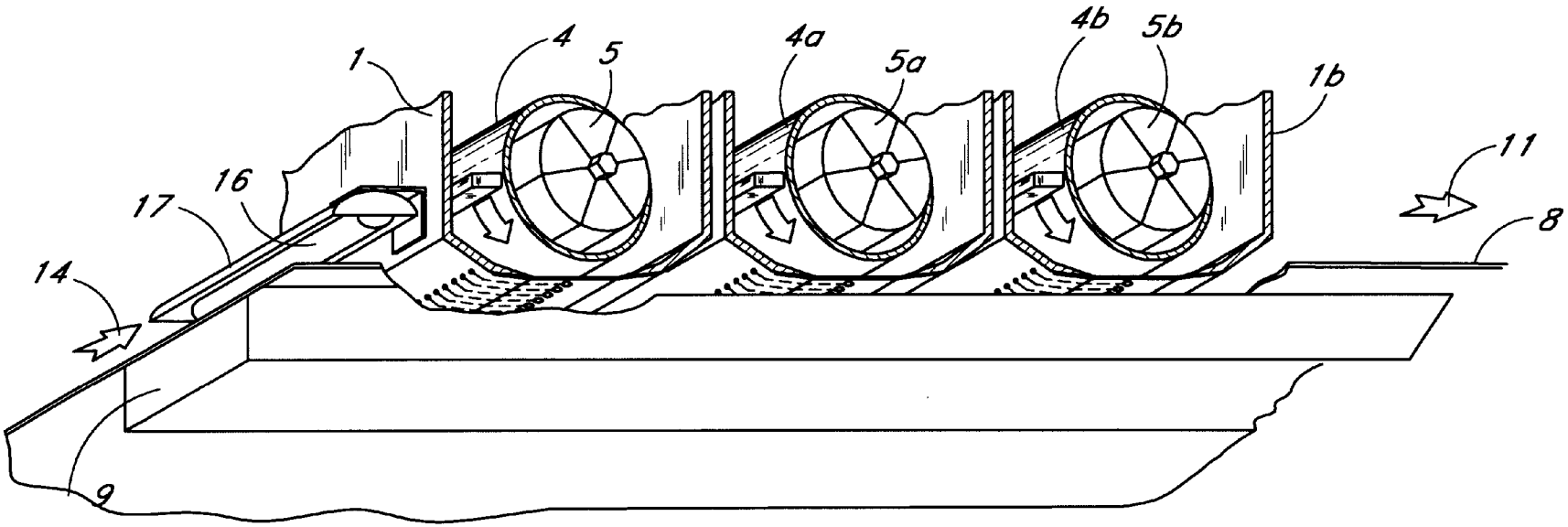
FIG. 10 is a schematic view illustrating a plurality of printheads on a single support system.

As shown in FIG. 10, two or more printhead assemblies 21 may be located on the same support rods 23 or double helix drive screw 28 for the purpose of increasing the printing speed or to print multiple colors. To print multiple colors, each of the containers 1 must have toner particles 2 of a different color.

I claim:

1. A method of recording images on an information carrier comprising:

positioning the information carrier between a fixed back electrode and a movable printhead including a matrix of control electrodes and a pigment particle carrier;

applying a control voltage to the control electrodes to open and close passages through the matrix to cause pigment particles to be drawn from the particle carrier and deposited on the information carrier to form visible images;

moving the particle carrier and matrix with respect to the information carrier while maintaining the matrix a constant distance from the back electrode, wherein said printhead moves in a first direction to deposit said pigment particles onto said information carrier, and moves in a second direction, opposite the first direction, to deposit pigment particles onto the information carrier; and rotating said particle carrier in one direction in response to moving said printhead in a first direction and rotating said particle carrier in an opposite direction in response to moving said printhead in a direction opposite to said first direction.

2. A method of recording images on an information carrier comprising:

positioning the information carrier between a fixed back electrode and a movable printhead including a matrix of control electrodes and a pigment particle carrier;

applying a control voltage to the control electrodes to open and close passages through the matrix to cause pigment particles to be drawn from the particle carrier and deposited on the information carrier to form visible images;

moving the particle carrier and matrix with respect to the information carrier while maintaining the matrix a constant distance from the back electrode; and cleaning unwanted toner particles from said matrix by rotating a magnetic roll adjacent the printhead to attract the unwanted particles, and wiping the particles off the roll.

3. A printing apparatus comprising:

a movable printhead including a matrix of individual control electrodes;

a fixed back electrode spaced from said matrix a predetermined distance defining a space between the back electrode and the matrix through which an information carrier may extend;

a mechanism, coupled to said printhead, to selectively move said printhead;

a printhead support which guides the moveable printhead so that the printhead moves adjacent to the information carrier while maintaining a constant distance from the back electrode;

voltage sources connected to the control electrodes to open and close passages through the control electrode matrix to cause charged pigment particles to be attracted from a particle carrier through the open passages and deposited on the information carrier to form visible images; and a cleaning assembly located outside the printing area to remove unwanted pigment particles from the surface of the control electrode matrix, wherein said cleaning assembly includes:

a rotatable, multiple pole magnet roll positioned so that, during cleaning of said printhead, the printhead is moved over the roll; and a cleaning blade positioned adjacent said roll to remove particles thereon.

4. The apparatus of claim 3, including an ion generator positioned adjacent a path of movement of said printhead to discharge and establish a uniform initial potential in said matrix.

5. A printing apparatus comprising:

a movable printhead including a matrix of individual control electrodes and a particle carrier;

a fixed back electrode spaced from said matrix a predetermined distance defining a space between the back electrode and the matrix through which an information carrier may extend;

a printhead support which guides the moveable printhead so that the printhead moves adjacent to the information carrier while maintaining a constant distance from the back electrode;

voltage sources connected to the control electrodes to open and close passages through the control electrode matrix to cause charged pigment particles to be attracted from said particle carrier through the open passages and deposited on the information carrier to form visible images;

two stationary tooth belt segments extending adjacent the printhead and in a direction of movement of the printhead;

a rotatable tooth wheel coupled to said printhead;

a mechanical link movably mounted on said printhead, said mechanical link having a first end and a second end;

a rotary belt, coupled to said tooth wheel and to said particle carrier, for transforming rotary motion of said tooth wheel into rotary motion of said particle carrier; and first and second single-direction wheels mounted on the first and second ends of said mechanical link, said first single-direction wheel and said link being positioned such that one of said tooth belt segments is located between the first single-direction wheel and said rotatable tooth wheel so that when said printhead is moved in a first printhead direction, said first end of said link moves said first single-direction wheel to press said one of said tooth belt segments into engagement with said rotatable tooth wheel to rotate said carrier in a carrier movement direction, said second single-direction wheel and said link being positioned such that the other tooth belt segment is located between the second single-direction wheel and said rotatable tooth wheel so that when said printhead is moved in a second printhead direction opposite said first printhead direction, said second end of said link moves said second single-direction wheel to press the other belt segment into meshing engagement with the rotatable tooth wheel to cause said carrier to continue to rotate in the same carrier movement direction.

6. The apparatus of claim 5, wherein said belt segments extend in generally spaced parallel relation with the teeth of one segment facing the teeth of the other segment and with said tooth wheel positioned between the segments, and said link is pivotally mounted on an axis on which said tooth wheel is mounted.

* * * * *